US005325542A

United States Patent [19]

Lenerville

[11] Patent Number: 5,325,542

[45] Date of Patent: Jul. 5, 1994

[54] DECORATIVE SOCK AND METHOD

[76] Inventor: Kimberly S. Lenerville, P.O. Box 131, Toast, N.C. 27049

[21] Appl. No.: 150,687

[22] Filed: Nov. 10, 1993

Related U.S. Application Data

[63] Continuation of Ser. No. 943,030, Sep. 10, 1992, abandoned.

[51] Int. Cl.[5] ..... A41D 27/08

[52] U.S. Cl. ..... 2/244; 2/239; D2/981

[58] Field of Search ..... 2/239, 244, DIG. 11; D2/330, 331, 332, 333, 334; 36/8.3, 11, 10, 136, 139, 1, 1.2; 63/1.1, 2, 4.3

[56] References Cited

U.S. PATENT DOCUMENTS

| | | | |
|---|---|---|---|
| D. 184,299 | 1/1959 | Barger | D2/334 |
| 228,363 | 6/1880 | Lambert | 2/186 |
| 409,400 | 8/1889 | Gumbinner | 2/244 |
| 2,291,791 | 8/1942 | Casserd | 36/139 |
| 2,811,811 | 11/1957 | Faranda | 36/139 |
| 3,701,166 | 10/1972 | Lindblom | 2/244 |
| 3,848,271 | 11/1974 | Goele | 2/338 |

FOREIGN PATENT DOCUMENTS 106105 11/1926 Australia ..... 2/244

OTHER PUBLICATIONS

Carlino Ad; *Earnshaws* Magazine, Jul. 1985.

Fredericks of Hollywood, 1947–1973, 26 Years of Mail-Order Seduction, 1973 (1954).

Charmers Inc. Ad, *Earnshaws* Review, vol. 71. Jul. 12, 1987, p. 75.

Illustrated Encyclopedia of Crafts, Marshall Cavendish, vol. 2, p. 137, 139, 1978.

*Primary Examiner*—Clifford D. Crowder

*Assistant Examiner*—Gloria Hale

[57] ABSTRACT

A decorative sock and method of using the same is provided whereby a series of bangle-like objects are affixed to streamers depending from the down turned cuff of the sock. During walking or dancing the objects collide to generate a pleasant sound which will draw attention to the wearer. Young girls are particularly interested in the decorative and attractive qualities of the sock.

18 Claims, 1 Drawing Sheet

DECORATIVE SOCK AND METHOD

This is a continuation of application Ser. No. 07/943,030 filed Sep. 10, 1992, now abandoned.

BACKGROUND OF THE INVENTION

1. Field Of The Invention

The invention herein pertains to decorative apparel and particularly for ornate socks of the dress variety which are worn by young girls for dancing and other occasions.

2. Description Of The Prior Art And Objectives Of The Invention

In recent years cosmetics, hair styling and clothing have become exceedingly important to teenage and younger girls. Many decorated and colorful garments are now commercially available and the present invention yet adds another dimension for the style conscious young lady. Thus, with much added emphasis on personal appearance and attractiveness of late, the present invention was conceived and one of its objectives is to provide a sock having a cuff which is pleasing in appearance and is decorative.

It is yet another objective of the present invention to provide a sock for wear with a downwardly turned cuff with a plurality of crocheted streamers suspended therefrom.

It is still another objective of the present invention to provide a sock which includes a series of colorful bangles which can be audibly recognized as a result of the wearer's movement.

It is also an objective of the present invention to provide a method for generating sounds utilizing the suspended bangles such as in a dance step or in other activities.

Various other ojectives and advantages of the present invention become apparent to those skilled in the art as a more detailed presentation is set forth below.

SUMMARY OF THE INVENTION

The invention herein pertains to a novelty sock and method whereby the sock can be worn and sounds audibly produced therewith. The sock comprises a conventional style knit or otherwise formed sock worn with a downwardly turned cuff. Suspended therefrom and surrounding the sock body are a plurality of bangles connected to the lower or terminal ends of relatively thin streamers joined to the cuff. The bangles may consist of a colorful plastic component of sufficient weight to cause the streamers to hang downwardly during normal wear while walking.

The method of the invention comprises wearing the socks as herein described and by rotating the foot to one side and then, rapidly rotating the foot to the other side causing the bangles to collide and generate an audible sound. The socks can thus be used in dancing or other similar activities to generate a pleasant "clicking" type sound.

DESCRIPTION OF THE PREFERRED EMBODIMENT

Figure 1:
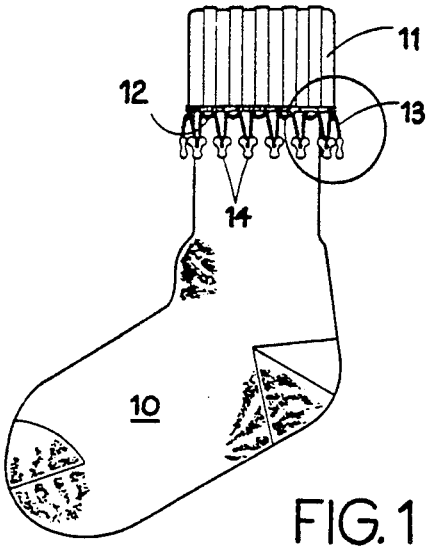
FIG. 1 illustrates a sock of the invention.
Figure 6:
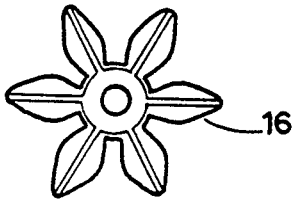
FIG. 6 demonstrates yet another embodiment of a bangle as used herein.

The preferred form of the invention is illustrated in FIG. 1 which comprises a conventional knit sock having a downwardly turned cuff. Swingably depending from the cuff is a series of crocheted streamers having bangles as shown in FIG. 6 affixed thereto at the terminal ends. The sock as shown is machine knit from a conventional cotton yarn and the crocheted streamers are thereafter affixed to the cuff such as by mechanical or manual means. Bangles which are attached to the streamers are formed from a hard polymeric material and present a distinctive "clicking" noise as the bangles collide as shown in FIG. 4.

Figure 3:
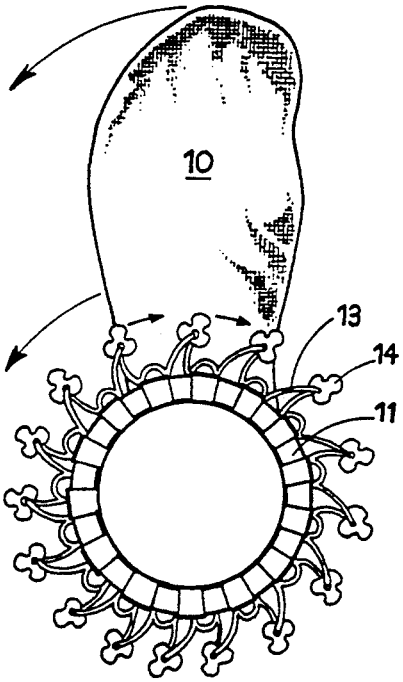
FIG. 3 shows the sock being worn with the foot rotated in a counterclockwise direction while the heel is on the floor.
Figure 4:
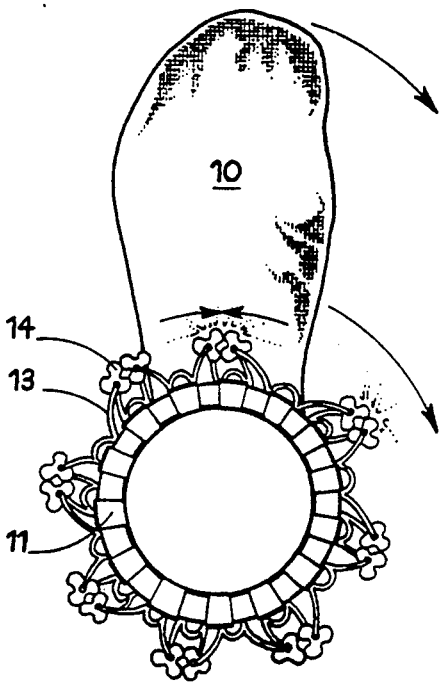
FIG. 4 depicts the foot as shown in FIG. 3 but moved approximately 45° in a rapid clockwise direction.

The preferred method of the invention comprises wearing the socks as shown in FIGS. 3 and 4 and by rapid rotation or movement of the foot from the left to right side causes the bangles to collide and audibly produce.

DETAILED DESCRIPTION OF THE DRAWINGS AND OPERATION OF THE INVENTION

Figure 2:
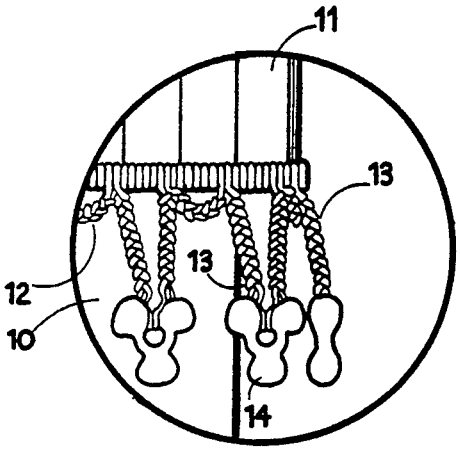
FIG. 2 demonstrates a close up view of a section of the cuff and bangles affixed thereto as seen in FIG. 1.
Figure 5:
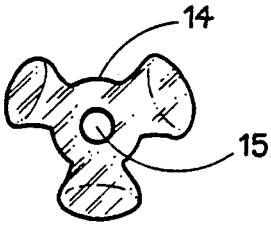
FIG. 5 pictures a close up of one embodiment of a bangle for attachment to a streamer.

Turning now to the drawings, FIG. 1 demonstrates a conventionally girl's knit cotton sock 10 as may be worn with a down turned cuff 11. Affixed to the cuff in side-by-side surrounding fashion is a decorative, manually crocheted design 12 having a streamer 13. As would be understood crocheted design 12 is also formed of a cotton yarn although other yarns may be used. Crocheted design 12 comprises a plurality of streamers 13 as shown in FIGS. 1 and 2 which ..allows bangles or bangle-like objects 14 to depend from cuff 11. Bangle-like objects 14 may include a variety of plastic or other bangles which are affixed to streamers 13 such as by looping streamer 13 through opening 15 of bangle-like objects 14 as shown in FIG. 5.

It is important that bangle-like objects 14 extend sufficiently downward from cuff 11 when motionless or at rest whereby adjacent objects 14 can readily collide and generate audible sounds during certain "stepping" dancing or the like, such as by rotating the foot. As would be understood, streamers 13 are formed from cotton or other yarn and are flexible to allow horizontal extension as shown in FIG. 3 if the foot is moved rapidly to the left or right. Also, if standing on the ball of the foot as shown in FIG. 4 and rapidly moving the foot to the left or counterclockwise and thereafter moving the foot to the right or clockwise, objects 14 collide with adjacent objects 14 as the rotational direction of the foot quickly changes. Another dance step may utilize the heel of the foot placed on the ground for the pivot point. Various conventional objects 14 which are commercially available can be used to provide weight to the end of streamers 13 and only two types are shown in FIGS. 5 and 6. Bangle-like object 16 (FIG. 6) provides a flower petal design whereas object 14 (FIG. 5) consists of a sphere cluster. The exact size of objects 14 or 16 can vary, however it is important that the material be hard and durable to supply both weight and have an audible quality when contacting an adjacent object 14.

Crocheted design 12 is likewise changable as various designs may be employed as can the method of production and attachment. Embroidering, knitting and sewing are but a few of the methods for forming or attaching streamers 13 and design 12.

Certain dance steps or foot movements can be used to cause objects 14 to collide and generate sound. Such steps can be performed in unison or by individuals to rapidly rotate the foot in first one, the in an opposite direction to cause the bangle-like objects to extend horizontally and collide during rotation.

The illustrations and examples provided herein are for explanatory purposes and are not intended to limit the scope of the appended claims.

I claim:

1. A sock with a cuff having a free end for producing a distinctly audible sound upon movement while being worn comprising: a plurality of streamers each of said streamers attached at one end to the free end of said cuff, a plurality of hard, relatively heavy bangle-like objects each attached to the other ends of said streamers, said objects for producing audible sound upon collision with another of said objects during sock movement.

2. The sock of claim 1 wherein said plurality of streamers are attached to encircle said sock.

3. The sock of claim 1 wherein said streamers are attached to said cuff wherein said bangle-like objects cause said streamers to hang downwardly when said sock is motionless.

4. The sock of claim 1 wherein said streamers are unadorned and are substantially exposed along their lengths.

5. The sock of claim 1 wherein said bangle-like objects are positioned on said streamers in collidable range with other of said objects on adjacent streamers.

6. A sock with a cuff having a free end for producing a distinctly audible sound while being worn comprising: a plurality of streamers, said streamers each attached at one end to the free end of said cuff, a plurality of bangle-like objects attached to the other end of each of said streamers, said streamers being substantially exposed and unadorned along their lengths, said bangle-like objects for producing audible sound upon collision with another of said bangle-like objects.

7. The sock of claim 6 wherein said streamers are affixed to said cuff so as to encircle said sock.

8. The sock of claim 6 wherein said bangle-like objects have sufficient weight to cause said streamers to hang downwardly when said sock is motionless.

9. The sock of claim 6 wherein said bangle-like objects are positioned on streamers in collidable range of other said bangle-like objects on adjacent streamers

10. The sock of claim 6 wherein said bangle-like objects produce a distinct audible sound upon collision with each other upon rotational movement of said sock.

11. A method of producing an audible sound comprising the steps of:

(a) donning a sock on the foot of a wearer, the sock having a downwardly turned cuff with a plurality of streamers attached to the free end of said cuff, encircling said cuff, said streamers each having a bangle-like object which will produce an audible sound upon collision with another bangle-like object, said bangle-like objects attached to ends of said streamers in collidable range with adjacent bangle-like objects, (b) moving the foot wearing the sock in a first direction and thereafter, (c) moving said foot in an opposite direction to cause said bangle-like objects to collide and produce an audible sound.

12. The method of claim 11 and including the step of placing a part of the foot on the ground.

13. The method of claim 12 wherein the step of placing a part of the foot on the ground comprises placing the ball of the foot on the ground.

14. The method of claim 12 wherein the step of placing a part of the foot on the ground comprises placing the heel of the foot on the ground.

15. The method of claim 11 wherein moving the foot in a first direction comprises rotating the foot in a clockwise direction.

16. The method of claim 11 wherein moving the foot in a second direction comprises rotating the foot in a counterclockwise direction.

17. The method of claim 11 and including the step of causing said bangle-like objects to audibly collide during changes in directional movement of the foot.

18. The method of claim 11 and including repeating steps (a) and (b) in rapid sequence.

* * * * *